United States Patent [19]

Stern et al.

[11] Patent Number: 5,069,390

[45] **Date of Patent: * Dec. 3, 1991**

[54] MANUALLY ADJUSTABLE SPRAY APPLICATOR

[75] Inventors: Donald J. Stern; Jeff S. Heaton, both of Bellingham; James A. Tryon, Seattle; Brett A. Bartholmey, Bellingham, all of Wash.

[73] Assignee: DJ S & T Limited Partnership, Bellingham, Wash.

[ * ] Notice: The portion of the term of this patent subsequent to Sep. 11, 2007 has been disclaimed.

[21] Appl. No.: 560,424

[22] Filed: Jul. 31, 1990

Related U.S. Application Data

[63] Continuation of Ser. No. 321,759, Mar. 10, 1989, Pat. No. 4,955,545.

[51] Int. Cl.[5] ..... B05B 7/24

[52] U.S. Cl. ..... 239/320; 239/345; 239/369; 239/375; 222/325; 222/401; 222/631

[58] Field of Search ..... 239/320, 345, 346, 355, 239/369, 375, 581.2, 456, 457, 458, 539; 222/325, 326, 285, 286, 394, 383, 401, 631

[56] References Cited

U.S. PATENT DOCUMENTS

| | | | |
|---|---|---|---|
| 604,151 | 5/1898 | Horn | 239/345 |
| 625,594 | 5/1899 | Oldham | 239/369 |
| 1,770,011 | 8/1930 | Poston | 239/458 |
| 1,988,017 | 1/1935 | Norwick | 239/378 |
| 2,887,274 | 5/1959 | Swenson | 239/375 |
| 4,195,780 | 4/1980 | Inglis | 239/457 |
| 4,411,387 | 10/1983 | Stern et al. | 239/345 |

*Primary Examiner*—Andres Kashnikow
*Assistant Examiner*—Karen B. Merritt
*Attorney, Agent, or Firm*—Hughes & Multer

[57] ABSTRACT

A spray applicator to discharge plaster or another texturizing material in a spray pattern against a wall surface or the like. There is a manually operated air cylinder and piston assembly which discharges pressurized air through a first nozzle, with an air jet traveling through an area where the plaster or the material descends from a container, with the air jet carrying some of the plaster through a forward discharge nozzle to cause a spray pattern. There is a rotatable adjusting sleeve which moves the two nozzles further apart or closer together to control the spray pattern and also to close the discharge nozzle.

19 Claims, 4 Drawing Sheets

MANUALLY ADJUSTABLE SPRAY APPLICATOR

This is a continuation of application Ser. No. 07/321,759, filed Mar. 10, 1989, now U.S. Pat. No. 4,955,545.

BACKGROUND OF THE INVENTION

1. Field of the Invention

The present invention relates generally to compression spray applicators for coating fluids, and more particularly to such a spray applicator for spraying viscous fluids, such as plaster or other texturizing material, onto a wall, ceiling or the like.

2. Background Art

There are in the prior art spray applicators where there is a chamber which contains a viscous fluid, such as plaster, with a forward fluid discharge nozzle through which the plaster is sprayed. There is a source of pressurized air (e.g., a manually operated cylinder and piston air pump, or possibly an air pressure structure which can be attached to a powered air compressor) from which air is discharged through an air nozzle which is axially aligned with, and positioned rearwardly of, the fluid discharge nozzle. The plaster or other material to be discharged moves into alignment with fluid discharge nozzle, and an air jet from the air nozzle propels the plaster or other fluid through the fluid nozzle in a spray pattern.

One such spray applicator is shown in U.S. Pat. No. 4,411,387 (Stern et al.), issued Oct. 25, 1983 and entitled "Manually Operated Spray Applicator". There is shown a spray applicator where there is a cylinder defining an air chamber, with a manually operated piston being positioned in the chamber in a manner that reciprocating motion of the piston causes air to pass through an air nozzle during the forward stroke of the piston. When the air in the air chamber becomes pressurized, it acts on a nozzle positioning plate to move the air nozzle rearwardly away from the fluid nozzle to permit the plaster or other fluid to pass into alignment with the fluid discharge nozzle so that this plaster or other fluid is discharged in a spray pattern. One of the problems toward which this patent is particularly directed is to stop the "dribbling" of the plaster or other material from the fluid discharge nozzle at the end of the piston stroke when the air pressure in the air chamber is dropping back to atmospheric pressure. To alleviate this, the apparatus is arranged so that just before the completion of the compression stroke of the piston, a pressure relief passageway is opened to permit a spring acting on the nozzle member to move the nozzle member forwardly to a closed position. On a subsequent stroke of the piston, the forward motion of the piston again pressurizes the air chamber to act through a passageway to act on the positioning plate to move the air nozzle rearwardly to its open position and again permit the discharge of the plaster or other material as a spray.

While the spray applicator described in U.S. Pat. No. 4,411,387 is certainly a practical and commercially viable design, there is perceived a need to provide a spray applicator of a simplified design which can be manufactured economically, yet which is reasonably effective in accomplishing a proper spray application of the plaster or other material. For example, such a simplified spray applicator would be desirable in a situation where a person needs the applicator for only limited use, such as spraying the plaster on a small area of a repair. For such an application, it may not be necessary to have all of the operating refinements of a more sophisticated spray applicator, but yet have the basic operating characteristics which provide overall effective operation.

It is toward this problem which the present invention is directed.

SUMMARY OF THE INVENTION

The present invention provides a manually operable spray applicator which is characterized in having a relatively simply design, but yet has the capability of operating effectively, particularly for spray application jobs of more limited scope, such as in applying plaster or other texture material to a small wall area where there has been a repair.

The spray applicator of the present invention discharges a fluid material, such as plaster in a spray pattern by means of pressurized air. There is a main housing structure having a longitudinal axis and comprising first an air pressurizing section which defines an air chamber. The housing structure also comprises an air nozzle section connected to a forward end of the cylinder section and providing an air nozzle which is aligned on the longitudinal axis. A manually operated piston is mounted for reciprocation in the air chamber to provide pressurized air for spray application on the forward stroke of the piston.

There is a fluid discharge structure which comprises a fluid nozzle section that provides a fluid discharge nozzle positioned on the longitudinal axis forwardly of the air nozzle. The air nozzle is arranged to received pressurized air from the air chamber and discharge the air forwardly as an air jet. The fluid discharge nozzle is arranged to receive the air jet from the air nozzle and discharge fluid, such as plaster, and air in a forward direction in a spray pattern. The spray applicator further comprises means defining a fluid containing chamber to supply the fluid to the fluid discharge.

The fluid discharge structure further comprises a mounting section to which the fluid nozzle section is mounted and which is in turn mounted to the housing structure so as to be movable between a forward position where the fluid nozzle is spaced a further distance forwardly of the air nozzle, and through intermediate positions to a rear position where the fluid nozzle is closely adjacent to the air nozzle. With the fluid discharge structure in the forward position, the fluid, such as plaster, is discharged in a pattern having relatively large particles of the fluid material. As the fluid nozzle moves more closely to the air nozzle, the size of the fluid particles decreases. When the fluid discharge nozzle moves to its rear position, it is in sufficiently close proximity to the air nozzle so that fluid is substantially prevented from passing out said fluid discharge nozzle.

Other features will become apparent from the following detailed description.

BRIEF DESCRIPTION OF THE PREFERRED EMBODIMENT

Figure 1:
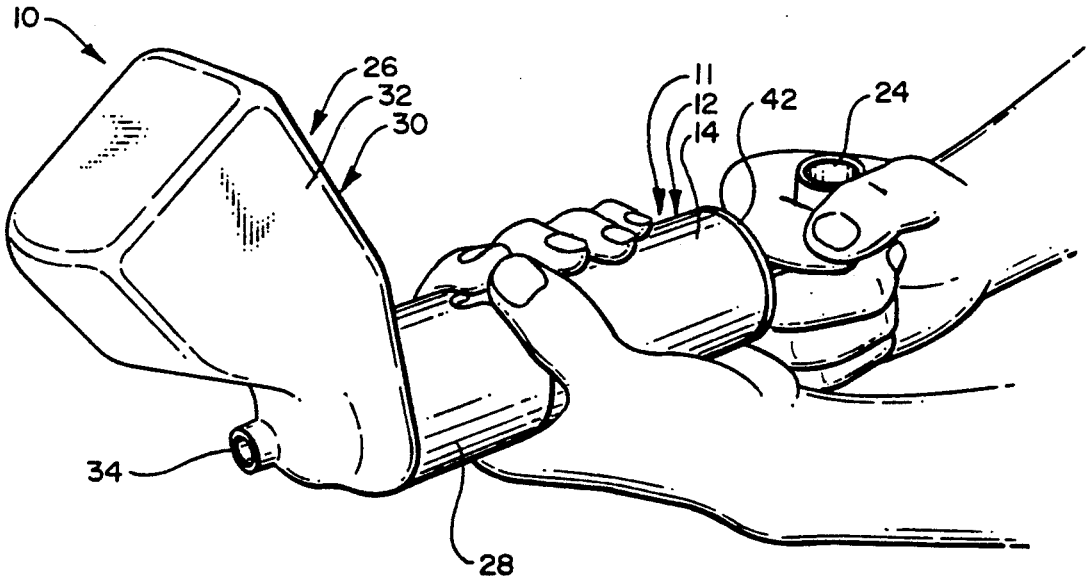
FIG. 1 is an isometric view of the spray applicator of the present invention, showing the invention being manually operated.
Figure 2:
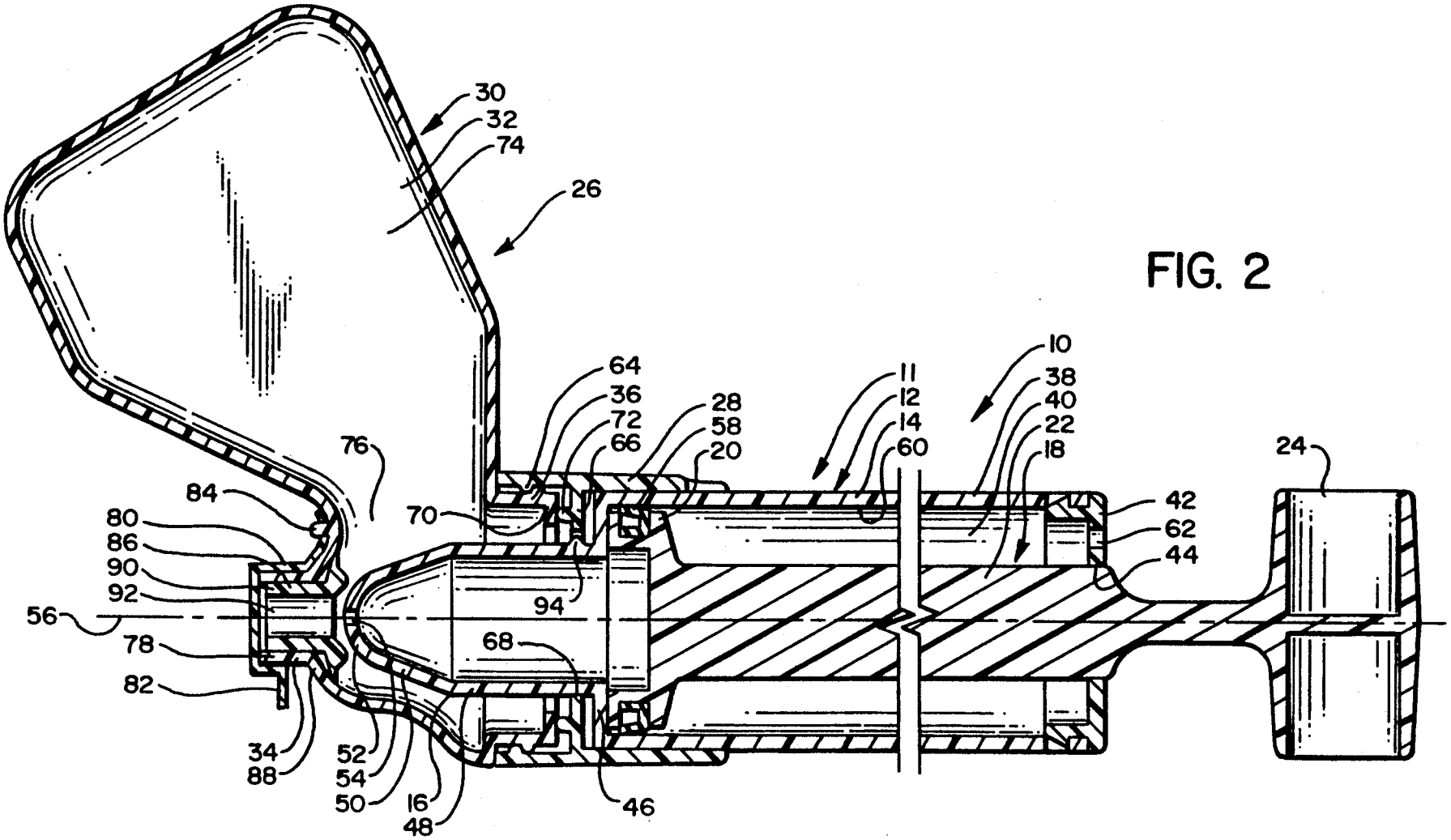
FIG. 2 is a sectional view taken along a longitudinal axis of the spray applicator of FIG. 1, with the fluid discharge nozzle being positioned at a more forward position to permit fluid, such as plaster to be discharged in a spray pattern having relatively larger particles of fluid material.
Figure 3:
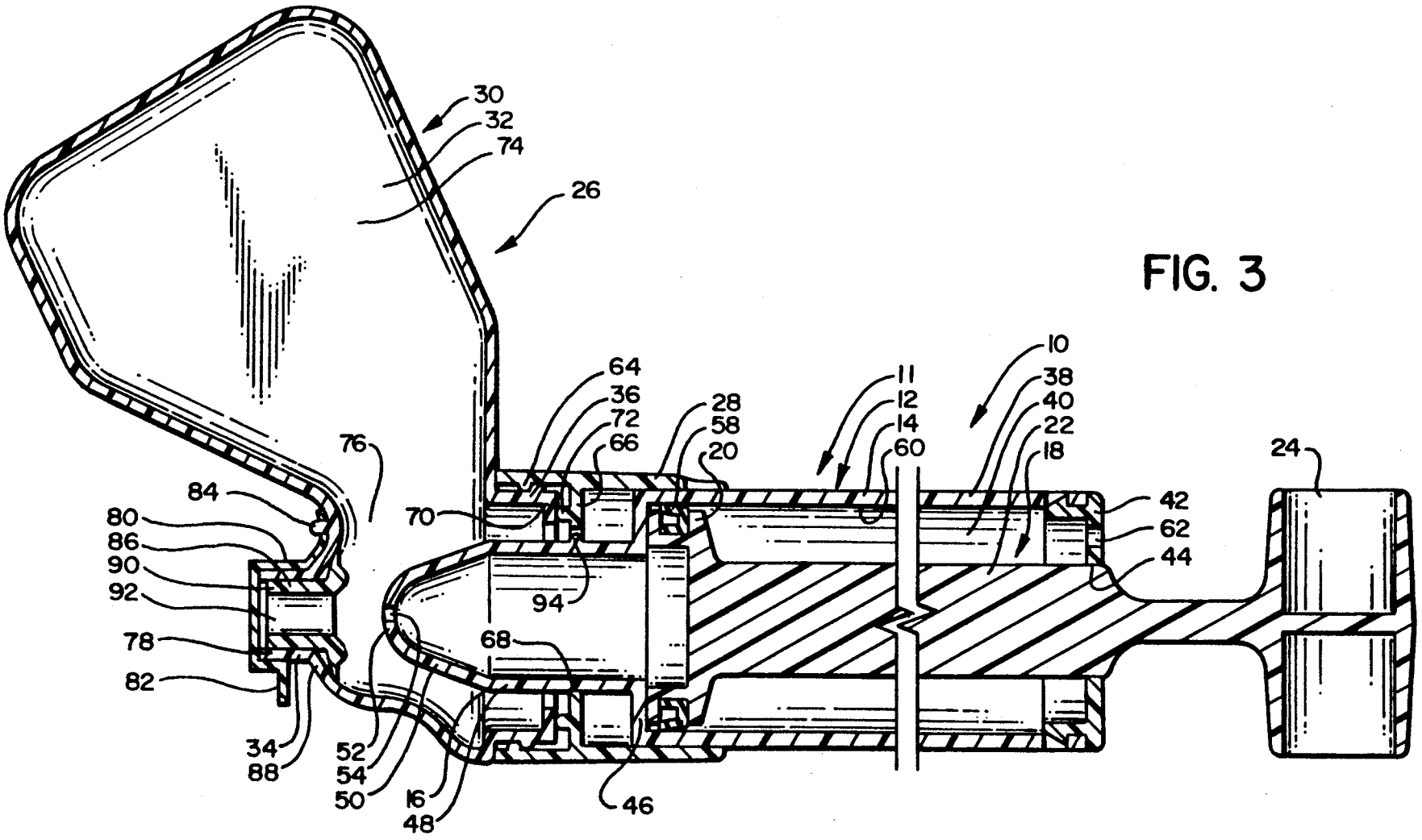
FIG. 3 is a longitudinal sectional view similar to FIG. 2, showing the fluid discharge nozzle at a rear location closely adjacent to said air nozzle so as to inhibit flow of fluid material, such as plaster, from said fluid discharge nozzle.

The apparatus 10 comprises an air pressurizing and supply means 11, which in turn comprises a housing structure 12 having an air pressurizing section 14 and an air nozzle section 16. Mounted to the housing structure 12 is a piston assembly 18, comprising an air pressurizing piston 20 connected to a rearwardly extending rod 22 that in turn is connected to a manually operable handle 24.

Mounted to the forward end of the housing structure 12 is a fluid supply and discharge means 26, which comprises first an adjustable mounting sleeve 28 and also a fluid container and discharge nozzle member 30 that is removably mounted to the front end of the mounting sleeve 28. The container and discharge nozzle member 30 has a container section 32 to contain plaster or other texturizing material, a discharge nozzle section 34, and a mounting section 36 by which the member 30 is removably mounted to the forward end of the mounting sleeve 28. In addition to serving a mounting function, the mounting sleeve 28 is rotatably mounted to the housing section 12 in a manner that relative rotational movement of the sleeve 28 and the housing section 12 causes movement of the sleeve 28 in an axial direction to bring the discharge nozzle section 34 either closer to or further way from the air nozzle section 16. This is considered to be a significant feature in the present invention, and this will be described in more detail later herein.

To proceed to a more detailed description of the present invention, the air pressurizing section 14 comprises a cylindrically-shaped sidewall 38 defining an air chamber 40 in which the piston 20 reciprocates. The aft end of the cylindrical sidewall 38 is closed by an end plate or plug 42 having a through opening 44 to receive the piston rod 22. The forward end of the cylindrical sidewall 38 has a radially inwardly extending flange 46 which "necks in" to be joined integrally to rear end of the aforementioned air nozzle section 16.

The air nozzle section 16 has a rear cylindrical sidewall portion 48 which is in turn integrally connected to a frusto-conical nozzle wall 50, with the forward end of the nozzle wall 50 terminating in a forward rounded portion 52 having a central through nozzle opening 54.

For purposes of description, the apparatus 10 can be considered as having a longitudinal center axis 56 which is coincident with the longitudinal center axis of the cylindrical sidewall 38 of the housing section 12. The piston assembly 18 is centered on, and is moved forwardly and rearwardly along, this longitudinal axis 56. The air discharge opening 54 is centered on the longitudinal axis 56 and arranged to discharge an air jet forwardly along the longitudinal axis 56.

The aforementioned handle 24 is conveniently shaped as a cylindrical member which is manually grasped so that the piston assembly 18 can be reciprocated forwardly and rearwardly. The piston 20 is formed with a circumferential outer groove in which is positioned a circular seal member 58 which is arranged in a conventional manner so that on the forward stroke, an airtight seal is formed against the interior surface 60 of the cylinder wall 38, while air is permitted to pass around the seal member 58 on the rearwardly traveling return stroke. A vent opening 62 is provided in the end plate 42 to facilitate the movement of air into the chamber 40.

The aforementioned mounting sleeve 28 has its forward end provided with interior helical threads 64 which engage matching exterior threads formed in the mounting section 36 of the container and discharge nozzle member 30. Thus, this member 30 can be removably attached to the mounting sleeve 28 simply by making the threaded connection at 64. Immediately rearwardly of the threaded portion 64, the sleeve 28 is formed with an integral radially inwardly extending annular flange 66 having an inner circular surface 68 that fits against the outer surface of the cylindrical sidewall portion 48 of the air nozzle section 16.

A circular lip 72 extends a short distance outwardly from the forward surface of the flange 66, and this lip 72 engages an inner edge of a circular lip 70 formed at the rear end of the mounting section 36 of the container and discharge nozzle member 30. The containing section 32 defines a chamber 74 which is initially filled with the material (e.g., plaster or some other texturizing material) which is to be discharged as a spray. As shown herein, this containing section 32 is formed in a somewhat rectangular configuration and has an upward and forward slope so as to be configured to cause the plaster or texturizing material contained therein to flow by gravity downwardly to the area of the discharge nozzle section 34, yet with the containing section 32 being positioned at a sufficiently far forward location to permit the mounting sleeve 28 and housing section 12 to be conveniently grasped manually. The lower end of the containing section 32 is formed with a throat 76 through which the plaster or texturizing material flows downwardly into the discharge area.

The aforementioned nozzle section 34 comprises first a mounting portion having a forwardly extending cylindrical wall 78 on which a closure cap 80 can be removably mounted. This closure cap 80 (as shown herein) has a tab 82 which can be manually grasped to remove the cap 80 from engagement with the mounting wall 78. Also, as shown herein, there is a mounting tab 84 by which the cap 80 can be attached to the member 30 at a location just above the mounting wall 78.

There is a separately formed nozzle element 86 having a frusto-conical wall 88 bonded to a matching frusto-conical portion of the nozzle discharge section 34. There is a cylindrical shaped discharge portion 90 defining a through opening 92 through which the plaster, texturizing material or other material is discharged in a spray pattern.

It will be noted that the discharge portion 90 of the nozzle element 86 is centered on the longitudinal axis 56 so that the fluid discharge opening 92 and the air nozzle opening 54 are aligned with one another.

Figure 4:
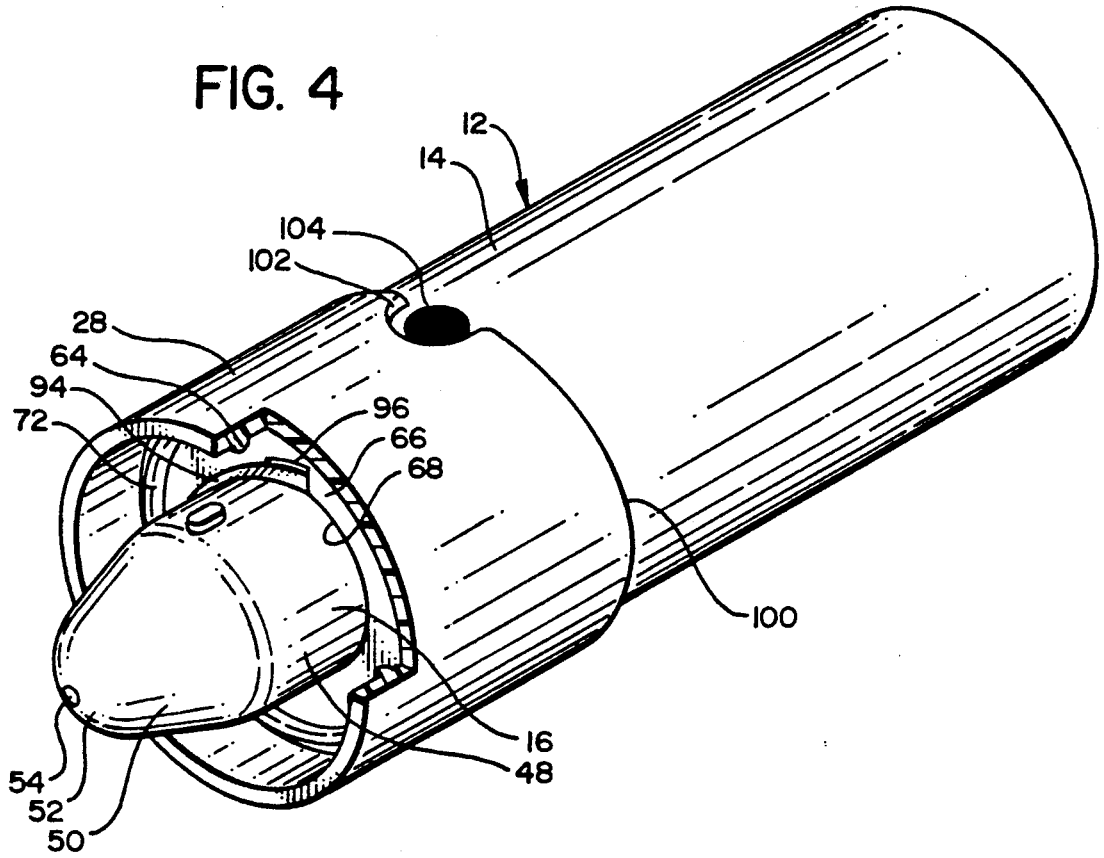
FIG. 4 is an isometric view showing only the housing structure with the air discharge nozzle, and also showing a portion of a mounting section which is mounted to the housing structure in a manner to be movable forwardly and rearwardly to cause the fluid discharge nozzle to be located at its forward and rear locations, respectively, as shown in FIGS. 2 and 3, with certain components or portions of the apparatus being omitted for ease of illustration.

It was mentioned earlier herein that the mounting sleeve 28 can be moved rotatably relative to the housing 12 to cause forward and rear adjustment of the fluid discharge nozzle section 34. This is accomplished by forming the cylindrical sidewall 48 of the air nozzle section 16 with a raised helical locating ridge or thread 94 that is received in a locating opening 96 that is formed at the interior edge surface 68 of the flange 66. (See FIG. 4.) It is readily apparent that as the sleeve 28 rotates relative to the housing section 12, the locating ridge 94 acts as a locating cam or member to cause the sleeve 28 to translate axially along the longitudinal center axis 56. In the present configuration, this locating ridge 94 is approximately 180 degrees in length.

The rear circumferential edge 100 of the sleeve 28 is conveniently provided with a circular cutout 102 which can be matched with markings (one of which is indicate schematically at 104) so that the axial spacing distance of the air nozzle section 14 and the fluid discharge nozzle section 36 can readily be determined.

To describe the operation of the present invention, plaster, texturizing material or some other fluid material is placed in the containing section 32 of the container and discharge member 30. The mounting sleeve 28 is rotated to the desired location so that the air nozzle section 16 and the discharge nozzle section 34 are spaced from one another at the desired distance. When these two nozzle sections are positioned closely adjacent to one another, the viscous material in the containing section 32 does not flow out the discharge nozzle opening 92. The relative location of the discharge nozzle section 34 to the air nozzle section 16 determines the particle size of the material which is discharged from the spray applicator 10.

The mounting sleeve 28 is rotated to the appropriate location so as to optimize the distance between the nozzle sections 16 and 34. Then the handle 24 is manually grasped with one hand, while the housing section 12 is grasped with the other hand. Then the piston assembly 18 is reciprocated, so that on the forward stroke, air in the cylinder chamber 40 is pressurized so that an air jet is discharged in a forward direction from the air nozzle opening 54. This air jet in turn causes particles of the plaster or other texture material to flow with the air out the discharge opening 92 in a spray pattern, so that this material is deposited in the desired arrangement on a wall or ceiling surface. On the return stroke of the piston 20, air flows past the piston 20 into the air chamber 40 to be discharged on the next forward pressure stroke of the piston 20.

As indicated above, the mounting sleeve 28 can be rotated to provide the optimized axial spacing distance between the nozzle members 16 and 34. Upon completion of the spraying application, the sleeve 28 is rotated to bring the nozzles sections 16 and 34 closely adjacent to one another to limit further flow of the plaster or the texture material from the discharge opening 92. Also, the closure cap 80 can be placed over the cylindrical mounting wall 78 to totally close off the discharge opening 92.

It is obvious that various modifications can be made to the present invention without departing from the basic teaching thereof.

What is claimed is:

1. A spray applicator to discharge a fluid material in a spray pattern by means of pressurized air, said applicator comprising:

a. a fluid discharge section comprising:

i. a mounting structure;

ii. a forwardly positioned fluid nozzle portion providing a fluid discharge nozzle means which is located on a longitudinally extending discharge axis;

iii. said fluid discharge section defining a fluid discharge region located adjacent to and rearwardly of said fluid discharge nozzle means;

iv. a fluid container mounted to said mounting structure and adapted to contain said fluid material, said container having a fluid discharge opening positioned to deliver said fluid material into said discharge region;

b. an air pressurizing and supply section comprising:

i. a housing defining an air chamber;

ii. an air nozzle portion positioned at a forward end of said housing and providing an air discharge nozzle means which is located at said fluid discharge region rearwardly of said fluid discharge nozzle means;

iii. a manually operable pressurizing member mounted in said housing for motion on a pressurizing stroke to provide pressurized air in said air chamber which is discharged through said air nozzle means to cause fluid material in said discharge region to be discharged through said fluid discharge nozzle means, and also for a return stroke;

c. said air pressurizing and supply section and said fluid discharge section being connected to one another for forward and rear movement relative to one another in a manner that said air discharge nozzle means moves toward and away from said fluid discharge nozzle means in a manner to control discharge of said fluid material through said fluid discharge opening means, each of said air pressure and supply section and said fluid discharge section being configured to be manually grasped so as to facilitate manually initiated movement toward and away from one another.

2. The applicator as recited in claim 1, wherein said fluid discharge section and said air pressurizing and supply section are provided with positioning means interengaged between said fluid discharge section and said air pressurizing and supply section in a manner that these can be properly located with respect to one another.

3. The applicator as recited in claim 1, wherein said applicator is arranged in a manner that said container is connected to said mounting structure so as to be moveable therewith during forward and rear relative movement of said fluid discharge section.

4. The applicator as recited in claim 3, wherein said air nozzle portion is fixedly connected to said housing.

5. The applicator as recited in claim 4, wherein said housing and said air nozzle portion are formed integrally with one another.

6. The applicator as recited in claim 1, wherein said air nozzle portion is fixedly connected to said housing.

7. The applicator as recited in claim 6, wherein said housing and said air nozzle portion are formed integrally with one another.

8. The applicator as recited in claim 1, wherein said container is removeably mounted to said mounting structure.

9. The applicator as recited in claim 8, wherein said container has a lower portion which extends around and defines at least partly said fluid discharge region.

10. The applicator as recited in claim 9, wherein said fluid discharge nozzle means comprises a separate nozzle member which is mounted in the lower portion of said container.

11. The applicator as recited in claim 8, wherein said container is connected to said mounting structure in a manner that said container is non-rotatably mounted about a forward to rear extending axis relative to said mounting structure.

12. The applicator as recited in claim 11, wherein said mounting structure and said housing are rotatably mounted to one another about said forward to rear extending axis.

13. The applicator as recited in claim 1, wherein said mounting structure and said housing are rotatably mounted to one another about a forward to rear extending axis.

14. A spray applicator to discharge a fluid material in a spray pattern by means of pressurized air, said applicator comprising:

a. a fluid discharge section:
   i. a mounting structure;
   ii. a forwardly positioned fluid nozzle portion providing a fluid discharge nozzle means which is located on a longitudinally extending discharge axis;
   iii. said fluid discharge section defining a fluid discharge region located adjacent and to rearwardly of said fluid discharge nozzle means;
   iv. said mounting structure having a mounting connecting means adapted to connect to a fluid container, with said fluid container being positioned to deliver said fluid material into said discharge region;

b. an air pressurizing and supply section comprising:
   i. a housing defining an air chamber;
   ii. an air nozzle portion positioned at a forward end of said housing and providing an air discharge nozzle means which is located at said fluid discharge region rearwardly of said fluid discharge nozzle means;
   iii. a manually operable pressurizing member mounted in said housing for motion on a pressurizing stroke to provide pressurized air in said air chamber which is discharged through said air nozzle means to cause fluid material in said discharge region to be discharged through said fluid discharge nozzle means, and also for a return stroke;

c. said air pressurizing and supply section and said fluid discharge section being connected to one another for forward and rear movement relative to one another in a manner that said air discharge nozzle means moves toward and away from said fluid discharge nozzle means in a manner to control discharge of said fluid material through said fluid discharge opening means, each of said air pressure and supply section and said fluid discharge section being configured to be manually grasped so as to facilitate manually initiated movement toward and away from one another.

15. The applicator as described in claim 14, wherein said fluid discharge section and said air pressurizing and supply section are provided with positioning means interengaged between said fluid discharge section and said air pressurizing and supply section in a manner that these can be properly located with respect to one another.

16. The applicator as described in claim 15, wherein said applicator is arranged in a manner that said container is connected to said mounting structure so as to be moveable therewith during forward and rear relative movement of said fluid discharge section.

17. The applicator as described in claim 16, wherein said housing and said air nozzle portion are formed integrally with one another.

18. The applicator as described in claim 14, wherein said air nozzle portion is fixedly connected to said housing.

19. The applicator as described in claim 18, wherein said housing and said air nozzle portion are formed integrally with one another.

* * * * *